US011306734B2

(12) United States Patent
Koga et al.

(10) Patent No.: US 11,306,734 B2
(45) Date of Patent: Apr. 19, 2022

(54) CENTRIFUGAL COMPRESSOR

(71) Applicant: MITSUBISHI HEAVY INDUSTRIES THERMAL SYSTEMS, LTD., Tokyo (JP)

(72) Inventors: Jun Koga, Tokyo (JP); Jyun Miyamoto, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 92 days.

(21) Appl. No.: 16/970,840

(22) PCT Filed: Feb. 20, 2019

(86) PCT No.: PCT/JP2019/006371
§ 371 (c)(1),
(2) Date: Aug. 18, 2020

(87) PCT Pub. No.: WO2019/163840
PCT Pub. Date: Aug. 29, 2019

(65) Prior Publication Data

US 2021/0115943 A1 Apr. 22, 2021

(30) Foreign Application Priority Data

Feb. 20, 2018 (JP) ..... JP2018-027734

(51) Int. Cl.
*F04D 29/44* (2006.01)
*F04D 17/12* (2006.01)

(52) U.S. Cl.
CPC ..... *F04D 29/44* (2013.01); *F04D 17/12* (2013.01)

(58) Field of Classification Search
CPC ..... F04D 17/12; F04D 29/444
See application file for complete search history.

(56) References Cited

U.S. PATENT DOCUMENTS 9,541,098 B2 1/2017 Duquette
10,760,587 B2 * 9/2020 Larosiliere ..... F04D 29/444
(Continued)

FOREIGN PATENT DOCUMENTS

CN 101571138 A 11/2009
CN 105339030 A 2/2016
(Continued)

OTHER PUBLICATIONS

Written Opinion of JP 2018027734 (Year: 2018).*
(Continued)

*Primary Examiner* — Woody A Lee, Jr.
*Assistant Examiner* — Brian O Peters
(74) *Attorney, Agent, or Firm* — Birch, Stewart, Kolasch & Birch, LLP

(57) ABSTRACT

A centrifugal compressor includes a rotary shaft; a hollow casing; a first-stage inlet guide vane; a first-stage impeller; a diffuser; a return flow channel; return vanes; a second-stage inlet guide vane; and a second-stage impeller. The return vanes are arranged at predetermined intervals in a circumferential direction of the rotary shaft and a vane angle of each return vane is changed in a region from a leading edge, at which the fluid is introduced, to a predetermined position and the vane angle is maintained constant in a region from the predetermined position to a trailing edge, at which the fluid is discharged, in terms of meridian plane distance in a direction from the leading edge to the trailing edge.

5 Claims, 6 Drawing Sheets

(56) References Cited

U.S. PATENT DOCUMENTS

| | | | | |
|---|---|---|---|---|
| 2014/0271170 | A1 | 9/2014 | Holbrook | |
| 2015/0003966 | A1 | 1/2015 | Duquette | |
| 2016/0327056 | A1* | 11/2016 | Nakaniwa | F04D 27/0238 |
| 2018/0347584 | A1* | 12/2018 | Larosiliere | F04D 17/06 |
| 2019/0055960 | A1 | 2/2019 | Hermes | |

FOREIGN PATENT DOCUMENTS

| | | | |
|---|---|---|---|
| DE | 10 2016 203 305 | A1 | 9/2017 |
| JP | 2009-264305 | A | 11/2009 |

OTHER PUBLICATIONS

International Search Report and Written Opinion of the International Searching Authority dated May 28, 2019 for Application No. PCT/JP2019/006371 with English translations.

Chinese Office Action and Search Report for Chinese Application No. 201980014326.0, dated Mar. 8, 2021, with English translation of the Office Action.

* cited by examiner

CENTRIFUGAL COMPRESSOR

TECHNICAL FIELD

The present invention relates to a centrifugal compressor that raises the pressure of a fluid to obtain a compressed fluid.

BACKGROUND ART

A centrifugal chiller is a large-capacity heat source machine that is used for a wide range of purposes such as air conditioning for a large-scale factory including a clean room like an electric and electronic factory and district cooling and heating. The centrifugal chiller is composed of a compressor that uses an impeller to compress a refrigerant gas, an evaporator, a condenser, and an economizer. In addition, the compressor is composed of a first-stage inlet guide vane, a first-stage impeller, a diffuser, a return flow channel, a second-stage inlet guide vane, a second-stage impeller, a diffuser, and a discharge scroll.

Examples of such a centrifugal compressor include a centrifugal compressor described in PTL 1 below.

CITATION LIST

Patent Literature

[PTL 1] Japanese Unexamined Patent Application Publication No. 2009-264305

SUMMARY OF INVENTION

Technical Problem

The outer diameter of the centrifugal compressor is set by the outer diameter of the diffuser at an outlet portion and the outer diameter at the outlet portion of the diffuser is set as large as possible to reduce pressure loss at the return flow channel. Meanwhile, it is desired that the centrifugal compressor is reduced in size to reduce the cost of material and to achieve an improvement in mountability. As a method of reducing the centrifugal compressor in size, it is conceivable to decrease the outer diameter of the diffuser at the outlet portion. However, in a case where the outer diameter of the diffuser at the outlet portion is decreased, a channel length is made short and pressure recovery at the diffuser becomes insufficient. In a case where a fluid of which pressure recovery is insufficient flows into the return flow channel, the flow speed of the fluid becomes high and thus pressure loss at the return vane disposed in the return flow channel becomes large. As a countermeasure against the above-described problem, it is conceivable to reduce the inflow speed of the fluid by increasing the vane height (channel width) of the return vane at an inlet portion. However, if the speed of the fluid flowing into the return vane becomes low, the efficiency of the entire compressor decreases and the performance improvement effect of the entire compressor becomes small.

The present invention has been made to solve the above-described problem and an object thereof is to provide a centrifugal compressor with which it is possible to suppress a decrease in performance while reducing the size thereof.

Solution to Problem

In order to solve the above-described problems, according to the present invention, there is provided a centrifugal compressor including a rotary shaft, a hollow casing that rotatably supports the rotary shaft and is provided with an intake port on one side in an axial direction of the rotary shaft and a discharge port on the other side, a first-stage inlet guide vane that is disposed in the intake port, a first-stage impeller that is disposed downstream of the first-stage inlet guide vane in the casing, a diffuser that is disposed downstream of the first-stage impeller in the casing, a return flow channel at which a fluid that flows from an inner side in a radial direction of the rotary shaft to an outer side in the radial direction after flowing through the diffuser is reversed to the inner side in the radial direction, return vanes that are disposed in the return flow channel, a second-stage inlet guide vane that is disposed downstream of the return vanes in the casing, and a second-stage impeller that is disposed downstream of the second-stage inlet guide vane in the casing, in which the return vanes are arranged at predetermined intervals in a circumferential direction of the rotary shaft and a vane angle of each return vane is changed in a region from a leading edge, at which the fluid is introduced, to a predetermined position and the vane angle is maintained constant in a region from the predetermined position to a trailing edge, at which the fluid is discharged, in terms of meridian plane distance in a direction from the leading edge to the trailing edge.

Therefore, the vane angle is changed in the region from the leading edge of the return vane to the predetermined position and the vane angle is maintained constant in the region from the predetermined position to the trailing edge. Accordingly, it is possible to improve efficiency on a large-flow rate side of the first-stage impeller shown when the opening degree of the first-stage inlet guide vane is near 100% and to improve efficiency on the large-flow rate side of the first-stage impeller on a reverse turning side. In addition, it is possible to improve efficiency on a large-flow rate side of the second-stage impeller on a reverse turning side of the first-stage inlet guide vane. Therefore, with the outer diameter of the diffuser at an outlet portion being made small, it is possible to achieve reduction in device size and it is possible to suppress a decrease in performance of the entire compressor with an improvement in efficiency.

In the centrifugal compressor according to the present invention, the predetermined position may be set in a region of 50% to 70% from the leading edge.

Therefore, since a region at which the vane angle is maintained constant is set to an appropriate region, efficiency on the large-flow rate side of the first-stage impeller can be improved.

In the centrifugal compressor according to the present invention, the vane angle in the region from the predetermined position to the trailing edge may be set to an angle along the radial direction of the rotary shaft.

Therefore, since an angle at which the vane angle is maintained constant is set to an angle along the radial direction of the rotary shaft, efficiency on the large-flow rate side of the first-stage impeller can be improved.

In the centrifugal compressor according to the present invention, a fluid channel area at the trailing edge of the return vane may be set to be larger than a fluid channel area at the leading edge of the return vane.

Therefore, it is possible to reduce pressure loss of a fluid flowing through the return vanes.

In the centrifugal compressor according to the present invention, a length of the second-stage inlet guide vane in the radial direction of the rotary shaft may be set to be smaller than a length of the return vane in the radial direction of the rotary shaft.

Therefore, since the length of the second-stage inlet guide vane in the radial direction of the rotary shaft is set to be smaller than the length of the return vane in the radial direction of the rotary shaft, efficiency on the large-flow rate side of the second-stage impeller can be improved.

In the centrifugal compressor according to the present invention, the trailing edge of the return vane and a leading edge of the second-stage inlet guide vane may be disposed to be offset from each other in the circumferential direction of the rotary shaft.

Therefore, since the trailing edge of the return vane and the leading edge of the second-stage inlet guide vane are offset from each other in the circumferential direction, a stream at the trailing edge on a pressure surface side of the return vane is restrained from colliding with the leading edge of the second-stage inlet guide vane and thus loss can be reduced.

Advantageous Effects of Invention

With the centrifugal compressor in the present invention, it is possible to suppress a decrease in performance while reducing the size thereof.

DESCRIPTION OF EMBODIMENTS

Hereinafter, preferred embodiments of a centrifugal compressor according to the present invention will be described in detail with reference to the accompanying drawings. Note that, the present invention is not limited by the embodiments and in a case where there are a plurality of embodiments, the present invention encompasses combinations of the embodiments.

First Embodiment

Figure 1:
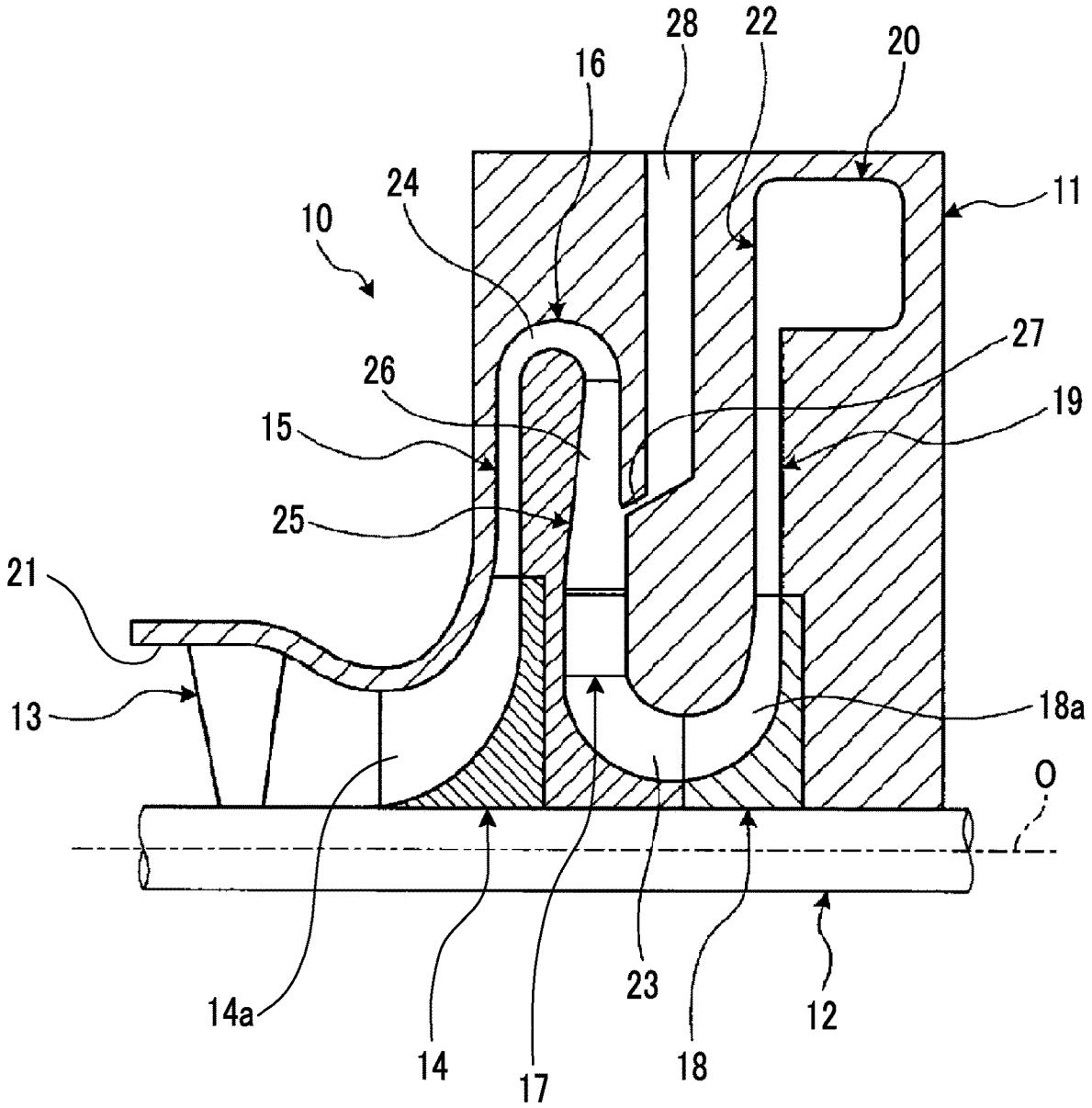
FIG. 1 is a schematic sectional view of a centrifugal compressor in a first embodiment.

FIG. 1 is a schematic sectional view of a centrifugal compressor in a first embodiment.

In the first embodiment, a centrifugal compressor 10 includes a casing 11, a rotary shaft 12, a motor (not shown), a first-stage inlet guide vane 13, a first-stage impeller 14, a diffuser 15, a return flow channel 16, a second-stage inlet guide vane 17, a second-stage impeller 18, a diffuser 19, and a discharge scroll 20.

The rotary shaft 12 is rotatably supported by the casing 11 such that the central axis thereof is disposed along a center line O. An output shaft of the motor is drivingly connected to the rotary shaft and a drive shaft can be driven and rotated. The first-stage impeller 14 and the second-stage impeller 18 are fixed to an outer peripheral portion of the rotary shaft 12 at a predetermined interval in an axial direction.

The casing 11 is provided with a suction port 21 through which a refrigerant gas flows in from the outside to one side of the center line O and the first-stage inlet guide vane 13 is disposed in the suction port 21. The first-stage inlet guide vane 13 is a movable vane. In addition, the casing 11 is provided with the discharge scroll (discharge port) 20 for discharging the refrigerant gas to the other side of the center line O. In addition, in the casing 11, an internal passage 22 through which the suction port 21 and the discharge scroll 20 communicate with each other is formed.

The first-stage impeller 14 and the second-stage impeller 18 are disposed in the internal passage 22. The first-stage impeller 14 forms a first compression stage and the second-stage impeller 18 forms a second compression stage. The first-stage impeller 14 and the second-stage impeller 18 are respectively provided with a plurality of blades 14*a* and 18*a* that extend radially outward from the outer peripheral portion of the rotary shaft 12.

The plurality of blades 14*a* and 18*a* are arranged at predetermined intervals (preferably, equal intervals) in a circumferential direction around the center line O. A channel through which the refrigerant gas flows is formed between the blades 14*a* and 18*a* that are adjacent to each other in the circumferential direction. The channel is gradually curved in a direction from a radial inner side to a radial outer side (downstream side in direction in which refrigerant gas flows), toward the other side of the center line O from the one side (upstream side in direction in which refrigerant gas flows) of the center line O.

The internal passage 22 is provided with the return flow channel 16 and a suction channel 23. The return flow channel 16 is connected to downstream sides of channels of the first-stage impeller 14 and the suction channel 23 connects a downstream side of the return flow channel 16 and upstream sides of channels of the second-stage impeller 18.

Through the return flow channel 16, the refrigerant gas flow in a direction from a channel outlet of the first-stage impeller 14 that is on the radial inner side to a channel inlet of the second-stage impeller 18 that is on the radial outer side. The return flow channel 16 includes the diffuser 15, a return bend portion 24, a straight channel 25, a return vane 26, and an intermediate suction port 27. The diffuser 15 guides, to the radial outer side, the refrigerant gas compressed by the first-stage impeller 14.

The channel area of the diffuser 15 as seen in a radial direction gradually increases toward the radial outer side from the radial inner side. As seen in a section containing the center line O, opposite wall surfaces of the diffuser 15 in a direction along the center line O extend toward the radial outer side from the radial inner side while being parallel to each other. An outer end portion of the diffuser 15 in the radial direction is connected to the straight channel 25 after being reversed toward the radial inner side via the return bend portion 24.

As seen in a section containing the center line O, the central portion of the return bend portion 24 is curved radially outward. That is, the return bend portion 24 has an arc shape connecting an outlet of the diffuser 15 and an inlet of the straight channel 25. The straight channel 25 extends radially inward from a downstream side end portion of the return bend portion 24. In the straight channel 25, a plurality of return vanes 26 are radially arranged around the center line O. By means of the straight channel 25, a fluid is guided to the radial inner side. The intermediate suction port 27 is provided at the position of the plurality of return vanes 26 and a chamber 28 is connected thereto.

The second-stage inlet guide vane 17 is disposed downstream of the straight channel 25 in which the plurality of return vanes 26 are disposed. The second-stage inlet guide vane 17 is a movable vane. A downstream side of the second-stage inlet guide vane 17 is connected to the upstream sides of the channels of the second-stage impeller 18 via the suction channel 23 and the diffuser 19 is disposed downstream of the channels of the second-stage impeller 18.

It is desired that the centrifugal compressor 10 configured as described above is reduced in size in consideration of manufacturing cost or mountability. In the present embodiment, size reduction is possible since the outer diameter of the diffuser 15 at an outlet portion is small and a decrease in performance is suppressed with a change in shape of the return vanes 26. Note that, in the following description, a large-size centrifugal compressor in the related art will be represented by a reference numeral "01" and a small-size centrifugal compressor in the related art will be represented by a reference numeral "02".

Figure 2:
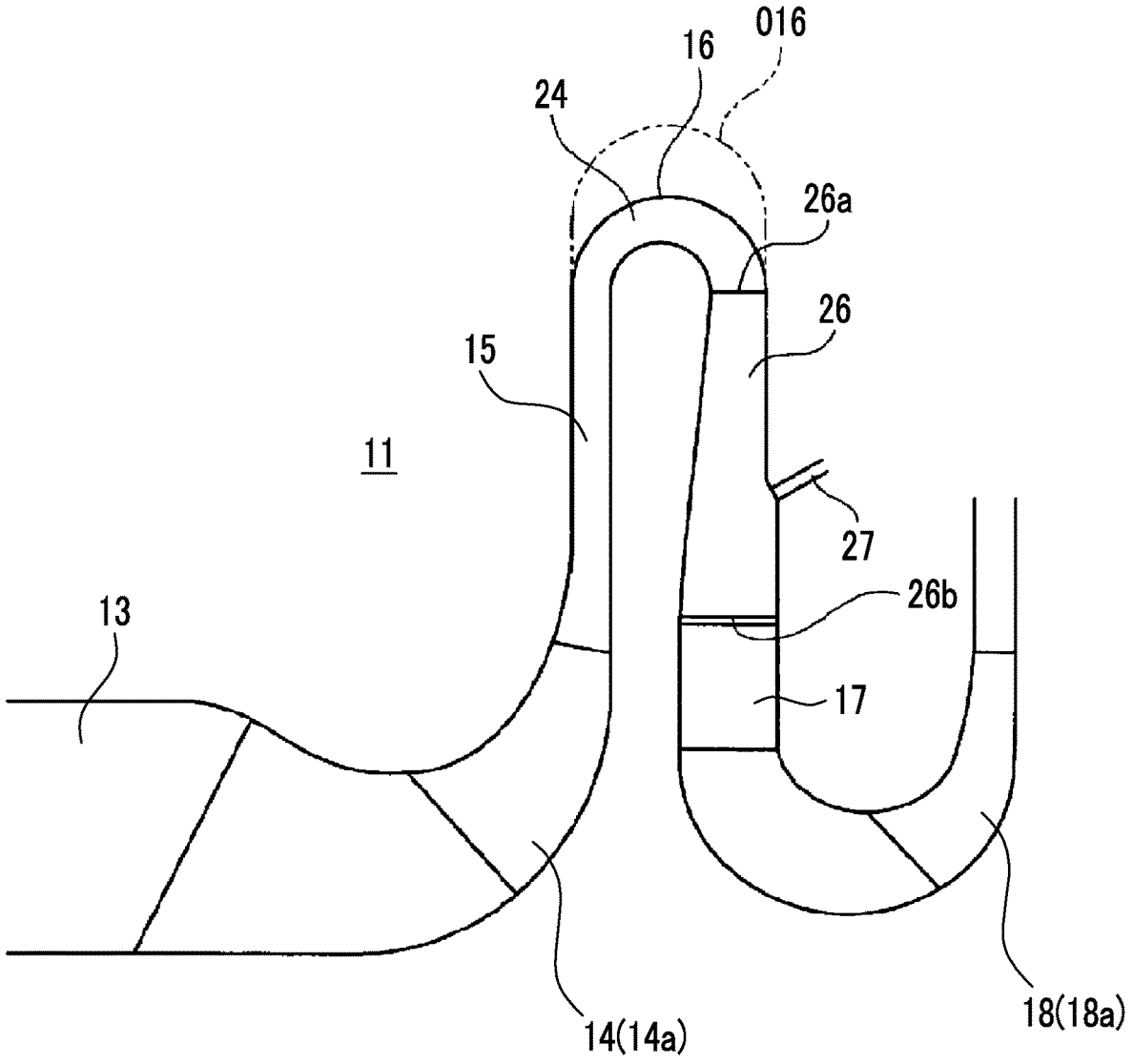
FIG. 2 is a schematic view showing an internal passage in the centrifugal compressor.
Figure 3:
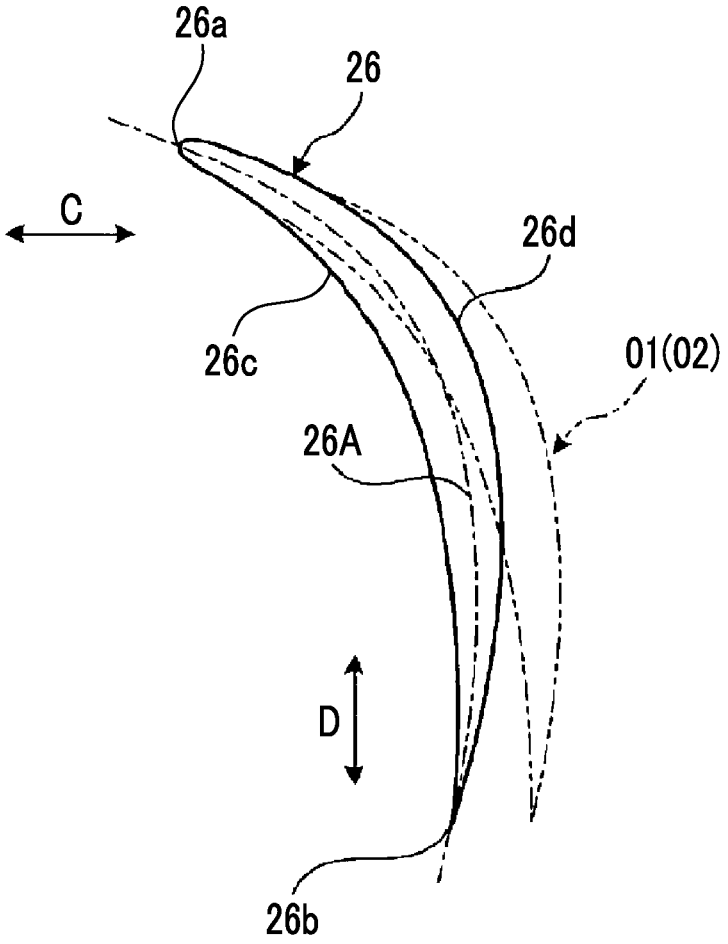
FIG. 3 is a schematic view showing a return vane.

FIG. 2 is a schematic view showing an internal passage in a centrifugal compressor and FIG. 3 is a schematic view showing a return vane.

As shown in FIGS. 1 and 2, the centrifugal compressor 10 in the present embodiment includes the casing 11, the rotary shaft 12, the first-stage inlet guide vane 13, the first-stage impeller 14, the diffuser 15, the return flow channel 16, the return vanes 26, the second-stage inlet guide vane 17, and the second-stage impeller 18. As in FIG. 2, the outer diameter of the diffuser 15 at the outlet portion in the centrifugal compressor 10 in the present embodiment is smaller than the outer diameter of a diffuser at an outlet portion in a centrifugal compressor in the related art. That is, the position of the return flow channel 16 is closer to the center line O side than the position of a return flow channel 16 and the centrifugal compressor 10 is small in size as a whole.

In addition, in the centrifugal compressor 10 in the present embodiment, the plurality of return vanes 26 are arranged at the predetermined intervals in the circumferential direction of the rotary shaft 12. The vane angle of each return vane 26 is changed in a region from a leading edge, at which a fluid is introduced, to a predetermined position and the vane angle is maintained constant in a region from the predetermined position to a trailing edge, at which the fluid is discharged, in terms of meridian plane distance in a direction from the leading edge to the trailing edge.

That is, as shown in FIG. 3, with respect to a radial direction D and a circumferential direction C of the rotary shaft 12 (refer to FIG. 1), the return vane 26 has a shape in which a center line 26A is curved in a region from a leading edge 26*a* to a trailing edge 26*b* and the shape thereof becomes parallel to the radial direction D in a region from a position ahead of the trailing edge 26*b* to the trailing edge 26*b*. In addition, a belly portion 26*c* of the return vane 26 has an inwardly curved sectional shape and a back portion 26*d* has an outwardly curved sectional shape.

Figure 4:
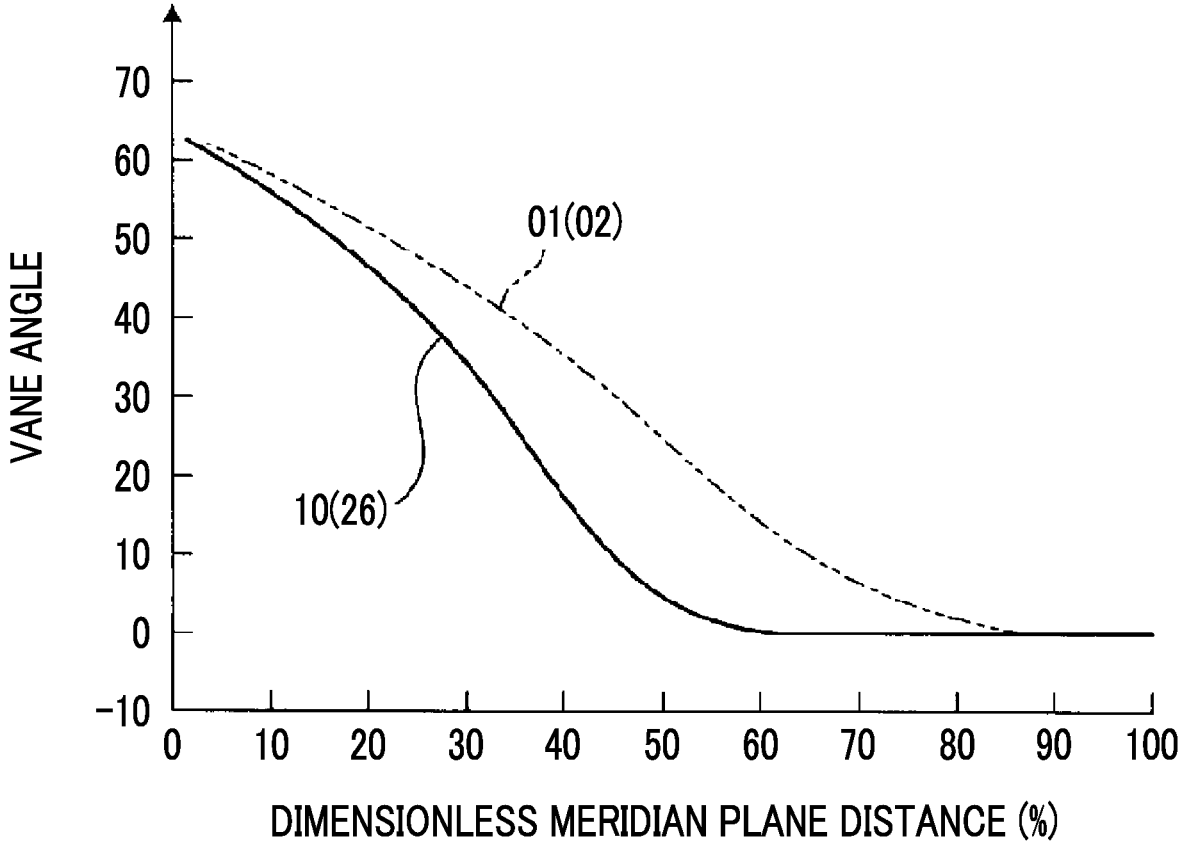
FIG. 4 is a graph showing the vane angle of the return vane with respect to a dimensionless meridian plane distance.

FIG. 4 is a graph showing the vane angle of a return vane with respect to a dimensionless meridian plane distance.

In FIG. 4, the horizontal axis represents a dimensionless meridian plane distance from the leading edge 26*a* of the return vane 26 and the vertical axis represents a vane angle with respect to the radial direction D of the rotary shaft 12 (refer to FIG. 1). The vane angle of a return vane in each of the centrifugal compressors 01 and 02 in the related art is continuously decreased from 60 degrees to 0 degrees in a region from a leading edge to a trailing edge in terms of meridian plane distance as above. Meanwhile, the vane angle of each return vane 26 in the centrifugal compressor 10 according to the present embodiment is continuously changed to be decreased from 60 degrees in a region from the leading edge 26*a* to a predetermined position corresponding to approximately 60% and the vane angle is maintained constant at 0 degrees in a region from the predetermined position corresponding to approximately 60% to the trailing edge 26*b*, in terms of meridian plane distance as above. It is preferable that the predetermined position is set in a region of 50% to 70% from the leading edge 26*a* in terms of meridian plane distance.

In addition, as shown in FIG. 2, in the present embodiment, the fluid channel area of the return flow channel 16 at the trailing edge 26*b* of the return vane 26 is set to be larger than the fluid channel area of the return flow channel 16 at the leading edge 26*a* of the return vane 26. Here, empirically, the ratio of the fluid channel area at the trailing edge 26*b* to the fluid channel area at the leading edge 26*a* is 2 to 3 and the ratio of the chord length of the return vane 26 to a leading edge channel height is set to 3 to 10.

Furthermore, the length of the second-stage inlet guide vane 17 in the radial direction of the rotary shaft 12 is set to be smaller than the length of the return vane 26 in the radial direction of the rotary shaft 12. Here, empirically, the radial length of the second-stage inlet guide vane 17 is less than ½ of the radial length of the return vane 26 and the length of a straight section of the return vane 26 is 25% to 35% of a distance from the rotary shaft to the trailing edge of the return vane 26.

Figure 5:
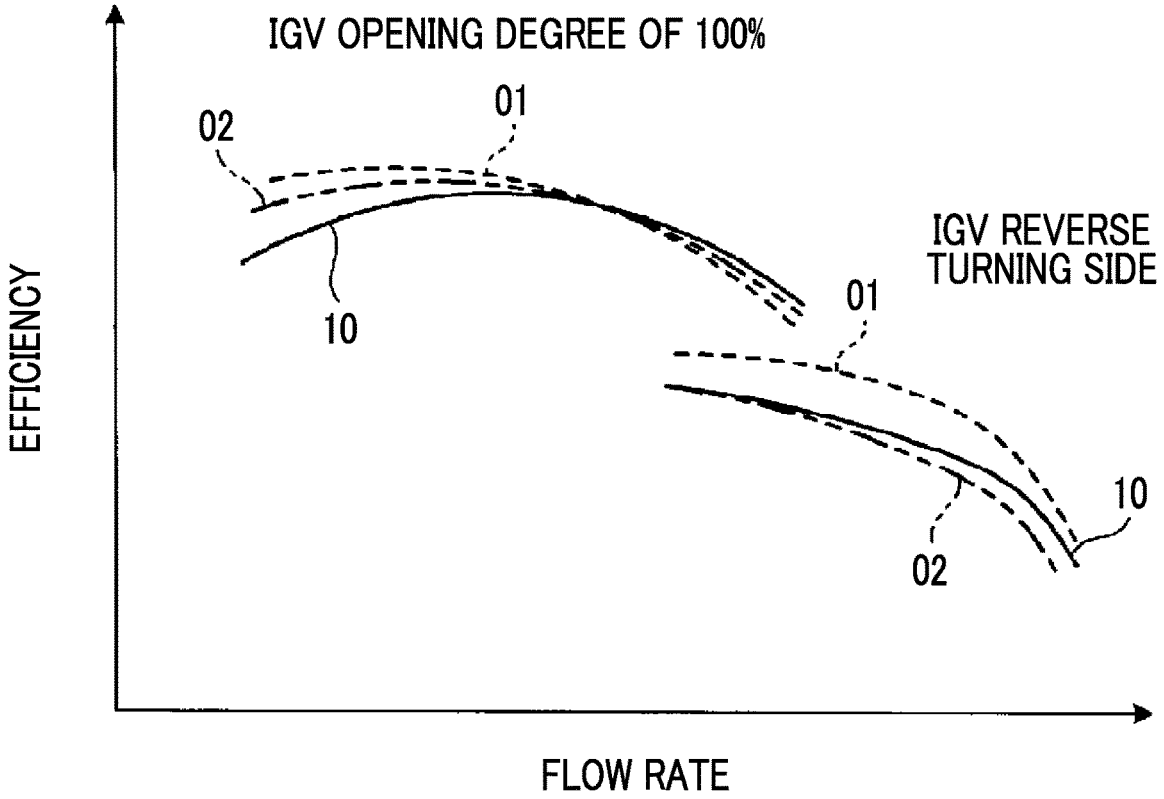
FIG. 5 is a graph showing efficiency at a first-stage IGV.
Figure 6:
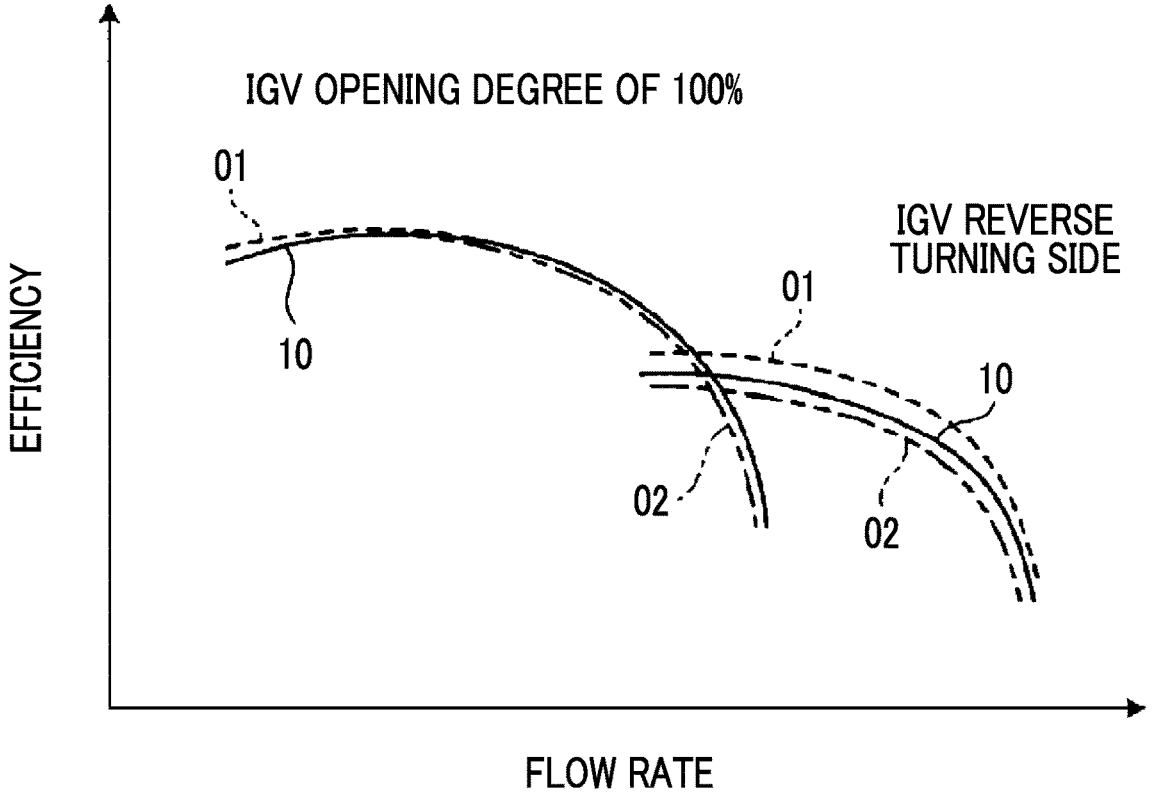
FIG. 6 is a graph showing efficiency at the entire compressor (second-stage IGV).

FIG. 5 is a graph showing efficiency at the first-stage IGV and FIG. 6 is a graph showing efficiency at the entire compressor (second-stage IGV).

As shown in FIG. 5, in the case of the centrifugal compressor 10 in the present embodiment, in comparison with the centrifugal compressors 01 and 02 in the related art, there is improvement in efficiency on a large-flow rate side of the first-stage impeller 14 shown when the opening degree of the first-stage inlet guide vane (IGV) is near 100%. Meanwhile, there is an improvement in efficiency on the large-flow rate side of the first-stage impeller 14 in comparison with the centrifugal compressor in the related art on a reverse turning side of the first-stage inlet guide vane (IGV) 13.

In addition, as shown in FIG. 6, in the case of the centrifugal compressor 10 in the present embodiment, in comparison with the centrifugal compressor 02 in the related art, there is an improvement in efficiency on a large-flow rate side of the second-stage impeller 18 shown when the opening degree of the first-stage inlet guide vane (IGV) 13 is near 100%. Meanwhile, there is an improvement in efficiency on the large-flow rate side of the second-stage impeller 18 in comparison with the centrifugal compressor 02 in the related art on the reverse turning side of the first-stage inlet guide vane (IGV) 13.

The centrifugal compressor 10 can decrease the flow rate by adjusting the first-stage inlet guide vane (IGV) to a forward turning side or increase the flow rate by adjusting the first-stage inlet guide vane (13) to the reverse turning side. In a case where a fluid suction amount is increased, the efficiency of the centrifugal compressor 10 is increased and the performance thereof is determined by the maximum fluid suction amount. Therefore, in the case of the centrifugal compressor 10 in the present embodiment, since there is an improvement in efficiency on the large-flow rate side of each of the impellers 14 and 18 on the reverse turning side of the first-stage inlet guide vane (IGV) 13, there is an improvement in performance of the centrifugal compressor 10.

As described above, the centrifugal compressor according to the first embodiment includes the casing 11, the rotary shaft 12, the first-stage inlet guide vane 13, the first-stage impeller 14, the diffuser 15, the return flow channel 16, the plurality of return vanes 26, the second-stage inlet guide vane 17, and the second-stage impeller 18 and the vane angle of each return vane 26 is changed in a region from the leading edge 26*a*, at which a fluid is introduced, to a predetermined position and the vane angle is maintained constant in a region from the predetermined position to the trailing edge 26*b*, at which the fluid is discharged, in terms of meridian plane distance in a direction from the leading edge 26*a* to the trailing edge 26*b*.

Therefore, with the outer diameter of the diffuser at the outlet portion being made small, the outer diameter of the centrifugal compressor 10 is made small and thus it is possible to achieve reduction in device size. In addition, although the outer diameter of the diffuser 15 at the outlet portion is made small, it is possible to suppress a decrease in performance of the entire compressor with an improvement in efficiency.

In the centrifugal compressor according to the first embodiment, the predetermined position is set in a region of 50% to 70% from the leading edge 26*a*. Therefore, since a region at which the vane angle is maintained constant is set to an appropriate region, efficiency on a large-flow rate side of the first-stage impeller 14 can be improved.

In the centrifugal compressor according to the first embodiment, the vane angle in the region from the predetermined position to the trailing edge 26*b* is set to an angle along the radial direction of the rotary shaft 12. Therefore, it is possible to improve efficiency on the large-flow rate side of the first-stage impeller 14.

In the centrifugal compressor according to the first embodiment, a fluid channel area at the trailing edge 26*b* of the return vane 26 is set to be larger than a fluid channel area at the leading edge 26*a* of the return vane 26. Therefore, it is possible to reduce pressure loss of a fluid flowing through the return vanes 26.

In the centrifugal compressor according to the first embodiment, the length of the second-stage inlet guide vane 17 in the radial direction of the rotary shaft 12 is set to be smaller than the length of the return vane 26 in the radial direction of the rotary shaft 12. Therefore, it is possible to improve efficiency on the large-flow rate side of the second-stage impeller 18.

Second Embodiment

Figure 7:
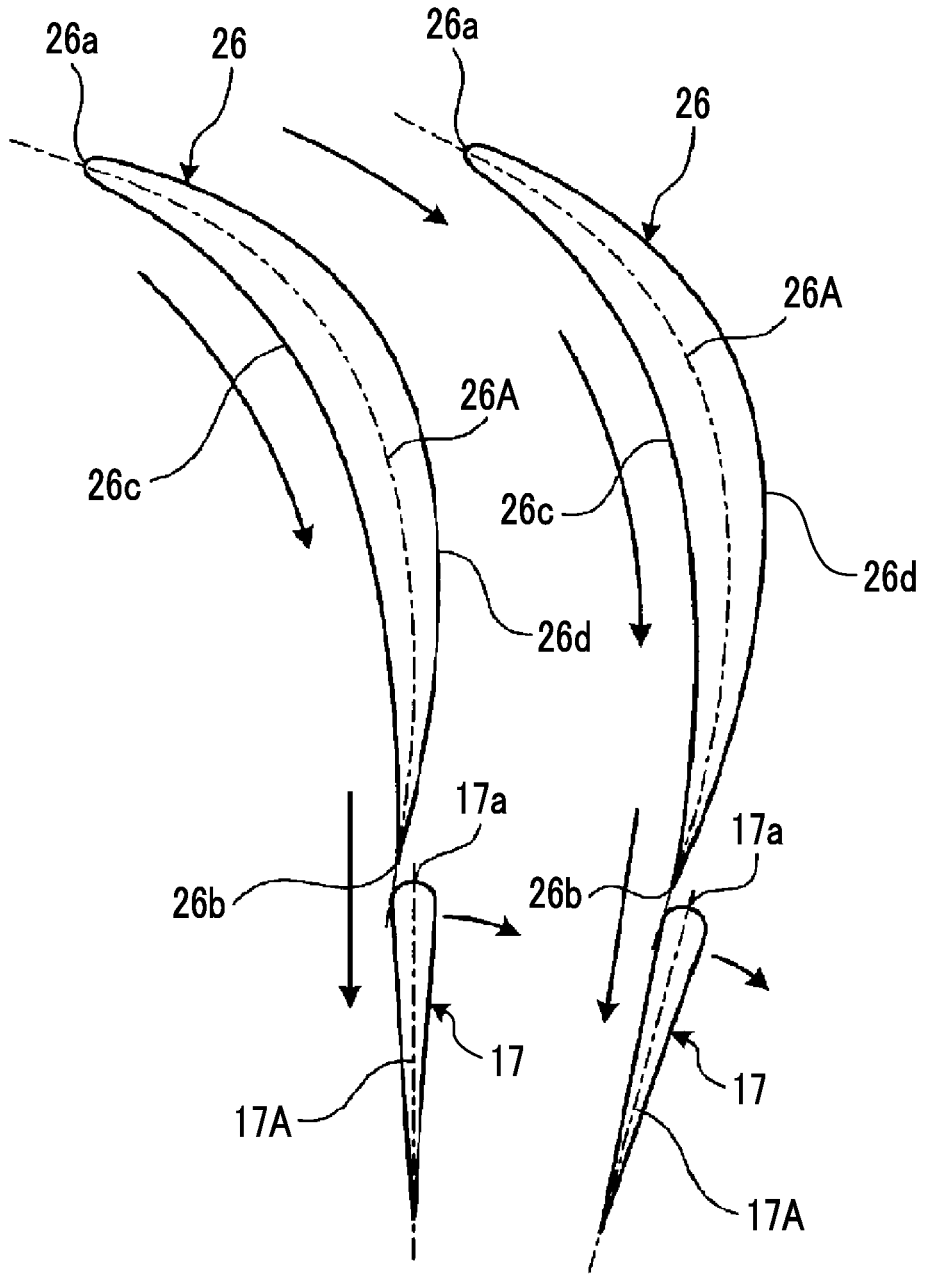
FIG. 7 is a schematic view showing return vanes in a centrifugal compressor according to a second embodiment.

FIG. 7 is a schematic view showing return vanes in a centrifugal compressor according to a second embodiment. Note that, members having the same functions as those in the above-described embodiment will be given the same reference numerals and detailed description thereof will be omitted.

In the second embodiment, as shown in FIG. 7, a plurality of (two in drawing) return vanes 26 are arranged at predetermined intervals in the circumferential direction of the rotary shaft 12. The vane angle of each return vane 26 is changed in a region from a leading edge, at which a fluid is introduced, to a predetermined position and the vane angle is maintained constant in a region from the predetermined position to a trailing edge, at which the fluid is discharged, in terms of meridian plane distance in a direction from the leading edge to the trailing edge. That is, the return vane 26 has a shape in which the center line 26A is curved in a region from the leading edge 26*a* to the trailing edge 26*b* and the shape thereof becomes parallel to the radial direction D in a region from a position ahead of the trailing edge 26*b* to the trailing edge 26*b*. In addition, the belly portion 26*c* of the return vane 26 has an inwardly curved sectional shape and the back portion 26*d* has an outwardly curved sectional shape.

Meanwhile, the vane angle of each return vane 26 is continuously changed to be decreased from 60 degrees in a region from the leading edge 26*a* to a predetermined position (50% to 70%) and the vane angle is maintained constant at 0 degrees in a region from the predetermined position (50% to 70%) to the trailing edge 26*b*, in terms of meridian plane distance. In addition, the second-stage inlet guide vane 17 is disposed such that a center line 17A thereof becomes offset from the center line 26A of the return vane 26 while being on the back portion 26*d* side (suction surface side) of the return vane 26 in the circumferential direction. That is, the trailing edge 26*b* of the return vane 26 and a leading edge 17*a* of the second-stage inlet guide vane 17 are offset from each other in the circumferential direction. It is preferable that the amount of offset thereof is set to a position of 10% to 20% of an interval (interval between center lines 26A) between the plurality of return vanes 26 in the circumferential direction. Note that, the second-stage inlet guide vane 17 can be operated in a clockwise direction (direction along arrow) from a position as shown in the drawing.

As described above, in the centrifugal compressor according to the second embodiment, the trailing edge 26*b* of the return vane 26 and the leading edge 17*a* of the second-stage inlet guide vane 17 are disposed to be offset from each other in the circumferential direction.

Therefore, when a fluid flowing along a pressure surface side, which is the back portion 26*d* of the return vane 26, flows from the trailing edge 26*b* to the second-stage inlet guide vane 17 side with the opening degree of the second-stage inlet guide vane 17 being 100%, the stream thereof is restrained from colliding with the leading edge 17*a* of the second-stage inlet guide vane 17 and loss can be reduced.

REFERENCE SIGNS LIST

10 centrifugal compressor
11 casing
12 rotary shaft
13 first-stage inlet guide vane
14 first-stage impeller
15 diffuser
16 return flow channel
17 second-stage inlet guide vane
17*a* leading edge
18 second-stage impeller
19 diffuser
20 discharge scroll
21 suction port
22 internal passage
23 suction channel
24 return bend portion
25 straight channel
26 return vane
26*a* leading edge
26*b* trailing edge
27 intermediate suction port
28 chamber
O, 17A, 26A center line

The invention claimed is:

1. A centrifugal compressor comprising:
a rotary shaft;

a hollow casing that rotatably supports the rotary shaft and is provided with an intake port on one side in an axial direction of the rotary shaft and a discharge port on the other side;

a first-stage inlet guide vane that is disposed in the intake port;

a first-stage impeller that is disposed downstream of the first-stage inlet guide vane in the casing;

a diffuser that is disposed downstream of the first-stage impeller in the casing;

a return flow channel at which a fluid that flows from an inner side in a radial direction of the rotary shaft to an outer side in the radial direction after flowing through the diffuser is reversed to the inner side in the radial direction;

return vanes that are disposed in the return flow channel;

a second-stage inlet guide vane that is disposed downstream of the return vanes in the casing; and a second-stage impeller that is disposed downstream of the second-stage inlet guide vane in the casing, wherein the return vanes are arranged at predetermined intervals in a circumferential direction of the rotary shaft and a vane angle of each return vane is changed from a leading edge, at which the fluid is introduced, to a predetermined position and the vane angle is maintained constant from the predetermined position to a trailing edge, at which the fluid is discharged, in terms of meridian plane distance in a direction from the leading edge to the trailing edge, and wherein the predetermined position is set 50% to 70% from the leading edge.

2. The centrifugal compressor according to claim 1, wherein the vane angle from the predetermined position to the trailing edge is set to an angle along the radial direction of the rotary shaft.

3. The centrifugal compressor according to claim 1, wherein a fluid channel area at the trailing edge of the return vanes are set to be larger than a fluid channel area at the leading edge of the return vanes.

4. The centrifugal compressor according to claim 1, wherein a length of the second-stage inlet guide vane in the radial direction of the rotary shaft is set to be smaller than a length of the return vanes in the radial direction of the rotary shaft.

5. The centrifugal compressor according to claim 1, wherein the trailing edge of the return vanes and a leading edge of the second-stage inlet guide vane are disposed to be offset from each other in the circumferential direction of the rotary shaft.

* * * * *